US010039684B2

(12) United States Patent
Meuleman et al.

(10) Patent No.: US 10,039,684 B2
(45) Date of Patent: Aug. 7, 2018

(54) REHABILITATION APPARATUS

(71) Applicant: MOOG BV, Nieuw-Vennep (NL)

(72) Inventors: Jos Meuleman, Bennebroek (NL); Piet Lammertse, Amstelveen (NL)

(73) Assignee: Moog BV, Nieuw-Vennep (NL)

( * ) Notice: Subject to any disclaimer, the term of this patent is extended or adjusted under 35 U.S.C. 154(b) by 451 days.

(21) Appl. No.: 14/650,988

(22) PCT Filed: Feb. 20, 2013

(86) PCT No.: PCT/EP2013/053354
§ 371 (c)(1),
(2) Date: Jun. 10, 2015

(87) PCT Pub. No.: WO2014/090414
PCT Pub. Date: Jun. 19, 2014

(65) Prior Publication Data

US 2015/0328078 A1 Nov. 19, 2015

(30) Foreign Application Priority Data

Dec. 12, 2012 (GB) ..... 1222322.8

(51) Int. Cl.

| | |
|---|---|
| ***A61H 1/00*** | (2006.01) |
| ***A61H 1/02*** | (2006.01) |
| ***A61H 5/00*** | (2006.01) |
| ***A61H 3/00*** | (2006.01) |

(52) U.S. Cl.
CPC ..... *A61H 1/0237* (2013.01); *A61H 3/008* (2013.01)

(58) Field of Classification Search
CPC ..... A61H 3/008; A61H 1/0237; A61H 13/00; A61H 1/02
USPC ..... 601/34
See application file for complete search history.

(56) References Cited

U.S. PATENT DOCUMENTS

| | | | | |
|---|---|---|---|---|
| 4,505,681 | A * | 3/1985 | Jones | A63C 11/10 273/DIG. 19 |
| 5,167,601 | A * | 12/1992 | Frappier | A63B 21/0004 482/121 |
| 5,803,881 | A * | 9/1998 | Miller | A63B 21/0004 482/124 |
| 6,666,798 | B2 * | 12/2003 | Borsheim | A61H 3/00 434/247 |
| 6,821,233 | B1 * | 11/2004 | Colombo | A61F 5/0102 482/54 |
| 7,278,954 | B2 | 10/2007 | Kawai et al. | |
| 7,331,906 | B2 * | 2/2008 | He | A61H 1/0237 482/69 |
| 7,416,538 | B2 | 8/2008 | Katoh et al. | |
| 7,998,040 | B2 * | 8/2011 | Kram | A63B 21/00181 482/124 |
| 9,713,439 | B1 * | 7/2017 | Wu | A61B 5/11 |
| 2002/0010056 | A1 | 1/2002 | Borsheim | |

(Continued)

FOREIGN PATENT DOCUMENTS

| | | |
|---|---|---|
| CN | 101862255 | 9/2011 |
| JP | 2005211328 | 8/2005 |

(Continued)

*Primary Examiner* — Garrett Atkinson
(74) *Attorney, Agent, or Firm* — Hodgson Russ LLP

(57) ABSTRACT

A gait rehabilitation apparatus (12) uses a mechanical shadow leg (42) positioned behind the biological leg (18) to provide forces and guide the biological leg in use.

15 Claims, 2 Drawing Sheets

(56) References Cited

U.S. PATENT DOCUMENTS

Figure 1:
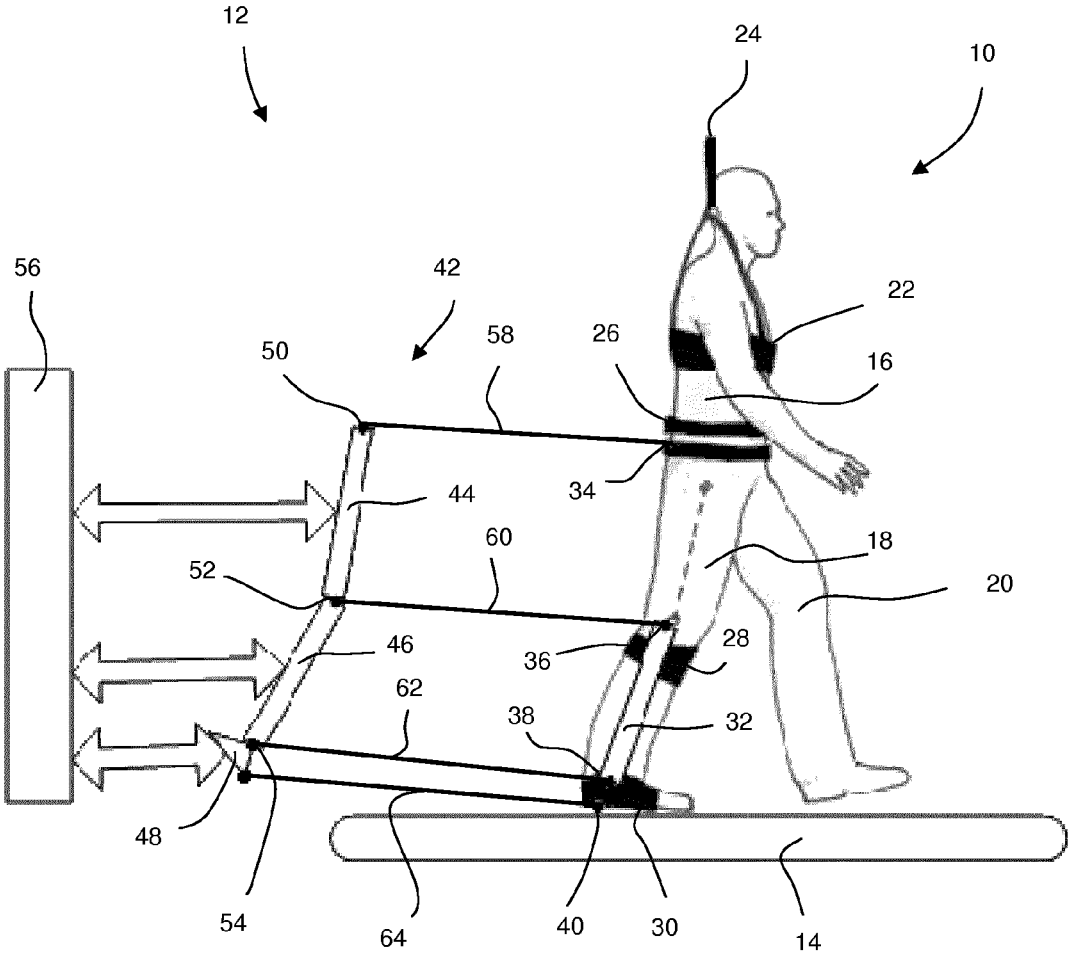

| | | | |
|---|---|---|---|
| 2006/0064047 | A1 | 3/2006 | Shimada et al. |
| 2009/0062884 | A1 | 3/2009 | Endo et al. |

FOREIGN PATENT DOCUMENTS

| | | |
|---|---|---|
| WO | 0114018 | 3/2001 |
| WO | 2007088044 | 6/2008 |
| WO | 2010105773 | 9/2010 |
| WO | 2012062283 | 8/2013 |

* cited by examiner

REHABILITATION APPARATUS

CROSS-REFERENCE TO RELATED APPLICATIONS

The present application is the U.S. national phase of International Application No. PCT/EP2013/053354 filed Feb. 20, 2013, which claims priority of British Application No. 1222322.8 filed Dec. 12, 2012, the entirety of which is incorporated herein by reference.

FIELD OF THE INVENTION

The present invention is concerned with an apparatus for driving and/or supporting a limb and an associated method. More specifically, the present invention is concerned with a mechanical apparatus for gait rehabilitation by guiding and/or applying forces to a limb of a human or animal subject.

BACKGROUND OF THE INVENTION

Medical conditions such as brain damage (stroke) and nerve damage (spinal cord injury) caused by accident or injury can result in the temporary loss or impairment of use of a subject's limbs. For example, the legs may be limited in their use such that the subject finds it difficult to walk. Following such injury or illness, a period of rehabilitation is typical during which nerve and/or muscle damage is repaired.

Such rehabilitation has been traditionally provided by a physiotherapist or physical therapist manually interacting with the subject. For example, the subject may walk on a treadmill or along a set path during which activity the physiotherapist will manually support and manipulate the subject's legs in order to provide the desired motion and feedback. By this process muscles and nerves can be gradually repaired.

Methods which involve the direct interaction of a physiotherapist, or require the physiotherapist to support and/or guide the subject are not ideal because they may result in uneven or unpredictable forces on the subject. It may also be uncomfortable for the therapist to undergo such activity for extended periods, potentially with numerous subjects. Fatigue or strength of the physiotherapist often is the limiting factor in therapy An alternative to the above mentioned method is to provide a mechanical gait rehabilitation robot. Mechanical gait rehabilitation robots are known in the art.

WO2012/062283 discloses a device which uses a number of flexible cords in tension to support a subject's limbs during rehabilitation. Another example of such a device can be seen in U.S. Pat. No. 7,998,040. Although such devices can apply uni-directional forces to the subject (with the cords in tension), they are not able to provide forces in the opposite direction (a flexible cord cannot carry a compressive force), or in other directions (e.g. sideways to retain the subject's leg in a set path).

U.S. Pat. No. 6,666,798 discloses an apparatus for rehabilitation in which a therapist is connected to a subject via a set of rigid links. This system is provided to free the physiotherapist's hands, and still requires the physiotherapist to bear the weight of, and guide, the subject's legs. Therefore the inherent lack of repeatability and potential for injury to the physiotherapist is still present. The disclosure is also only concerned with lower leg rehabilitation, having the ankle and knee connected to the therapist. Therefore rehabilitation of the upper leg is not considered.

Prior art document CN101862255B discloses a known type of rehabilitation apparatus which has a mechanical leg at the side of the patient's leg. A problem with this type of apparatus is that it needs to be provided with extendible leg members in order to account for various different sizes of patient. As such, this apparatus is particularly complicated and time consuming to set up for each individual patient.

SUMMARY OF THE INVENTION

It is an aim of the present invention to overcome or at least alleviate the above mentioned problems with the prior art.

According to a first aspect of the invention there is provided a gait rehabilitation apparatus comprising an articulated mechanical shadow leg configured to mimic the movement of a biological leg, a first member extending from the shadow leg and having a first biological leg attachment formation defined thereon, wherein the first member extends in a substantially anteroposterior direction relative to the shadow leg in use.

Advantageously, the provision of an articulated, mechanical shadow leg positioned behind the leg of the subject allows for controlled, repeatable and reliable movement to be introduced. The joints of the shadow leg can be arranged so that only desired motion of the subject is permitted. Furthermore, because the shadow leg is positioned behind the subject's leg, various different sizes of subject can be accommodated. Evidently, the position of the first member will change depending on the size of the patient, however, this would not be significant enough to serious affect the kinematics of the mechanism.

Preferably, there is provided a second member extending from the shadow leg and having a second biological leg attachment formation defined thereon; wherein the second member extends in a substantially anteroposterior direction relative to the shadow leg in use.

Preferably, the articulated shadow leg comprises an upper leg portion articulated about a shadow hip joint at an upper end in use.

Preferably, the first member extends from proximate the shadow hip joint, and the second member extends proximate a knee region of the shadow leg.

Preferably, the articulated shadow leg comprises a lower leg portion articulated about a shadow knee joint at an upper end in use.

Preferably, the first member extends from proximate the shadow knee joint, and the second member extends proximate an ankle region of the shadow leg.

Preferably, the articulated shadow leg comprises a foot portion articulated about a shadow ankle joint at an upper end in use.

Preferably, the first member extends from proximate the shadow ankle joint, and the second member extends proximate a foot region of the shadow leg.

Preferably, there is provided a third member extending from the shadow leg and having a third biological leg attachment formation defined thereon; wherein the third member extends in a substantially anteroposterior direction relative to the shadow leg in use.

Preferably, the articulated shadow leg comprises an upper leg portion articulated about a shadow hip joint at an upper end in use; and, a lower leg portion connected to the upper leg portion and articulated about a shadow knee joint at an upper end in use.

Preferably, the first member extends from proximate the shadow hip joint, the second member extends proximate the shadow knee joint and the third member extends proximate an ankle region of the shadow leg.

Preferably, a fourth member is provided extending from the shadow leg and having a fourth biological leg attachment formation defined thereon; wherein the fourth member extends in a substantially anteroposterior direction relative to the shadow leg in use.

Preferably, the articulated shadow leg comprises a foot portion connected to the lower leg portion and articulated about a shadow ankle joint at an upper end in use.

Preferably, the fourth member extends proximate a foot region of the shadow leg.

According to a second aspect of the present invention, there is provided a method of gait rehabilitation comprising the steps of providing an articulated mechanical shadow leg configured to mimic the movement of a biological leg, providing a first member connected to the shadow leg, providing a second member connected to the shadow leg, attaching the first and second members to the biological leg of a subject such that the first and second members extend in a substantially anteroposterior direction and, using the shadow leg to guide and/or provide force input to the biological leg.

BRIEF DESCRIPTION OF THE DRAWING VIEWS

An example gait rehabilitation apparatus and method in accordance with the present invention will now be described with reference to the accompanying figures in which:—

Figure 2:
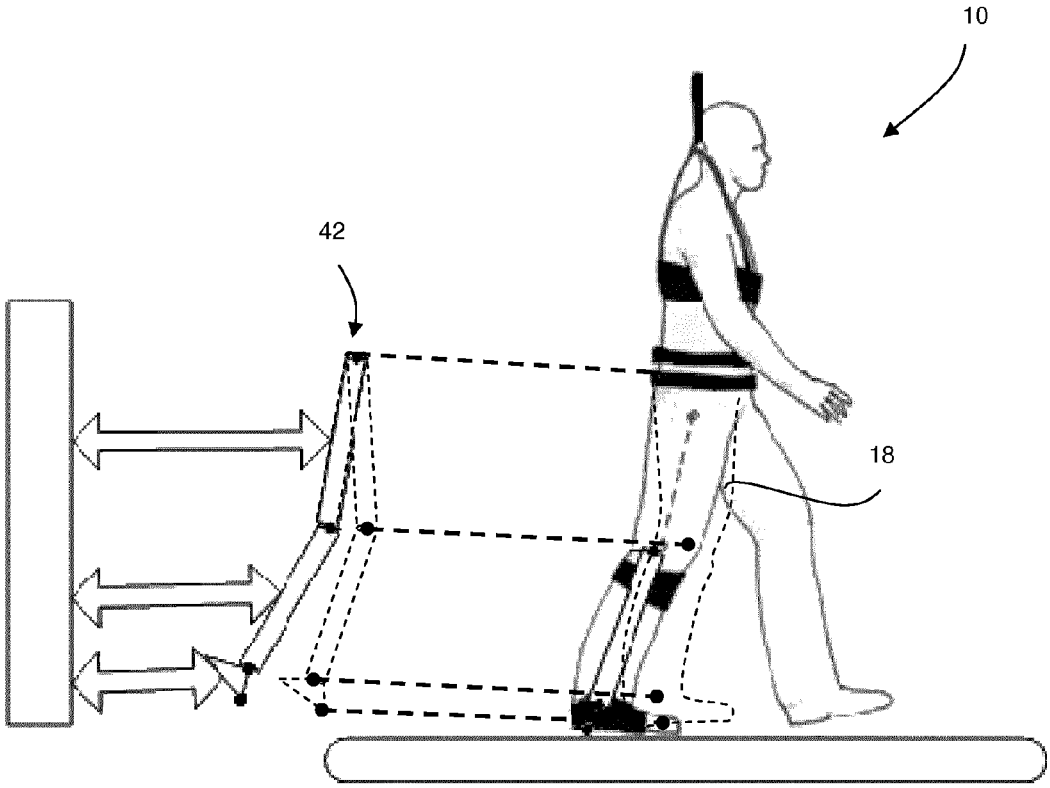

FIG. 1 is a side schematic view of an embodiment of a gait rehabilitation apparatus in accordance with the present invention; and FIG. 2 is a further schematic side view of the apparatus of FIG. 1.

DETAILED DESCRIPTION OF THE INVENTION

With reference to FIG. 1, a subject 10 is attached to an apparatus 12 in accordance with the present invention. The subject 10 is supported by, and walking on a treadmill 14. Such treadmills are well known in the art. The subject 10 has a torso 16, a right leg 18 and a left leg 20.

The apparatus 12 of the present invention comprises a torso harness 22, which wraps around the subject's torso 16. The harness 22, and therefore at least some of the weight of the subject 10 is supported from a mounting point 24 directly above the subject 10. In the event that the subject cannot support their own weight, the harness 22 provides some assistance.

A waistband 26 is positioned around the mid-section of the subject's torso 16. The waistband is an adjustable belt of material which can be securely fastened to the patient. A leg strap 28 is wrapped around the subject's leg just below the knee. The leg strap also comprises an adjustable strip of material. Finally, a foot harness 30 is positioned around the subject's foot. The foot harness 30 is a cradle in which the foot rests, and comprises a stiff inflexible member extending from the ankle to the base of the foot. The foot harness 30 is attached to the foot such that it moves therewith rotationally and translationally.

A substantially inflexible lower leg member 32 is attached to, and positioned between, the leg strap 28 and the ankle region of the side member of the foot harness 30. The member 32 is adjustable in length as will be discussed below. The lower leg member 32 reacts excessive side-to-side forces cause by misalignment of the knee and ankle which would put the knee under significant stress. It also reacts any tangential forces on the knee which may move the leg strap 28.

An attachment point 34 is provided at the lower part of the subject's back on the waistband 26. A second attachment point 36 is provided at an upper end of the member 32 and is coincident with the flexion/extension axis of the subject's knee. A third attachment point 38 is provided proximate a lower end of the member 32, at the top of the foot harness 30 and is oriented to be substantially coincident with the flexion/extension axis of the subject's ankle. The member 32 is adjusted during fitting to ensure that the attachment points 36 and 38 align with the knee and ankle respectively. Finally, a fourth attachment point 40 is provided at the base of the subject's foot proximate the heel.

The apparatus 12 comprises a shadow leg 42 comprising an upper leg member 44, a lower leg member 46 and a foot member 48.

The upper leg member 44 is a stiff, elongate member of approximately the same length of an average human thigh. The upper leg member 44 is connected at its top end to a support (not shown) by a shadow hip joint 50 which allows articulation about an axis perpendicular to the page (and therefore equivalent to the extension/flexion movement of the subject's hip when walking).

At the opposite, lower end of the upper leg member 44, there is provided a shadow knee joint 52 which connects the upper leg member 44 and the lower leg member 46. The shadow knee joint 52 is a rotational joint which also has an axis of rotation perpendicular to the page (and therefore equivalent to the extension/flexion movement of the subject's knee when walking).

At the lower end of the lower leg member 46, there is provided a shadow ankle joint 54 which again has an axis of rotation perpendicular to the page, per the subject's ankle in flexion/extension. The shadow ankle joint 54 connects the lower leg member 46 to the foot member 48.

Members 44, 46 and 48 each define together a shadow leg 42 which can be articulated by a suitable actuation system which is shown schematically at 56. The actuation system 56 is capable of applying forces and/or motion constraints to the members 44, 46 and 48. The actuation system 56 may take the form of an automated control system employing various electric motors or hydraulic or pneumatic cylinders. It is within the skill of the notional skilled person to provide a suitable actuation system for movement of the shadow leg 42.

Because the dimensions of the subject's legs are known, a geometric transformation can be provided as part of the automated control system which can relate movement of the shadow leg to movement of the subject's leg. In other words, for a required movement of the subject's leg, the system can calculate through which angles to actuate the shadow leg to produce the desired result.

The shadow leg 42 and the right leg 18 of the subject 10 are connected by a plurality of members extending in an anteroposterior direction. A first member 58 extends from the shadow hip joint 50 to the attachment point 34 at the lower back of the subject 10. A second member 60 extends from the shadow knee joint 52 to the attachment point 36 at the knee of the subject 10. A third member 62 extends from the shadow ankle joint 54 to the attachment point 38 at the ankle of the subject 10. A fourth member 64 extends from the bottom of the shadow foot 48 to the fourth attachment point 40 at the base of the foot of the subject 10. Each member 58, 60, 62, 64 is rotatably mounted to the shadow leg 42 for rotation about axes parallel to the joints therein.

Each of the members 58, 60, 62 and 64 are elongate, stiff members constructed from e.g., metal or a composite. Each member is the generally the same length, and as such the motion of the shadow leg 42 and biological leg 18 are constrained together. The member 60 is provided with some minor adjustability to ensure that when the shadow leg is fully extended, so is the subject's knee. This provides a mechanical stop on knee over-extension (which can be very harmful if permitted).

The members are of a length longer than the members of the shadow leg 44, 46, 48 and are about 1 m long.

The motion of the shadow leg 42 and biological leg 18 is demonstrated with respect to FIG. 2, in which the shadow leg 42 and the biological leg 18 have both advanced to a further position shown in hidden line.

It will be noted that advantageously, the size of the subject 10 is not important. Should a larger or smaller subject be installed within the apparatus then the members 58, 60, 62 and 64 may spread apart slightly depending on the relative size of the subject's leg, however, because the members 58, 60, 62 are relatively long, the kinematics of the device will remain substantially the same. The fact that each of the members 58, 60, 62 and 64 are of a length that is longer than either the upper or lower leg members 44, 46 means that this change in size of the subject 10 has little effect on the relative movement of the patient's leg as compared to the shadow leg.

Variations fall within the scope of the present invention. For example, instead of the subject 10 being placed on the treadmill 14, the apparatus 12 may be mobile, i.e., mounted on a trolley or other mobile device such that the patient can walk around freely whilst being rehabilitated.

The shadow leg 42 has mechanical restraints imparted thereon in order to avoid any excessive articulation of the subject's joints. For example, the knee joint 52 is limited by mechanical end stop to 180 degrees or thereabouts such that the patient 10 cannot hyperextend their knee.

The functionality of the torso harness may be integrated into the waistband, to support the subject at the waist instead of the torso.

What is claimed is:

1. A gait rehabilitation apparatus comprising:

an articulated mechanical artificial shadow leg configured to mimic the movement of a biological leg;

a first member coupled to the shadow leg and having a first biological leg attachment formation defined thereon for attachment of the first member to a biological leg of a user;

wherein the first member extends in a substantially anteroposterior direction to or from the shadow leg in use, and the first biological leg attachment formation is located in a plane in front of or behind the shadow leg in use, whereby the biological leg of the user is located in a plane in front of or behind the shadow leg in use.

2. A gait rehabilitation apparatus according to claim 1, comprising:

a second member coupled to the shadow leg and having a second biological leg attachment formation defined thereon for attachment of the second member to the biological leg of the user; wherein the second member extends in a substantially anteroposterior direction to or from the shadow leg in use.

3. A gait rehabilitation apparatus according to claim 2, in which the articulated shadow leg comprises an upper leg portion articulated about a shadow hip joint at an upper end in use, wherein the shadow hip joint is at the height of the user's hip joint in use.

4. A gait rehabilitation apparatus according to claim 3, in which the first member extends from proximate the shadow hip joint, and the second member extends proximate a knee region of the shadow leg.

5. A gait rehabilitation apparatus according to claim 2, in which the articulated shadow leg comprises a lower leg portion articulated about a shadow knee joint at an upper end in use, wherein the shadow knee joint is at the height of the user's knee joint in use.

6. A gait rehabilitation apparatus according to claim 5, in which the first member extends from proximate the shadow knee joint, and the second member extends proximate an ankle region of the shadow leg.

7. A gait rehabilitation apparatus according to claim 2, in which the articulated shadow leg comprises a foot portion articulated about a shadow ankle joint at an upper end in use, wherein the shadow ankle joint is at the height of the user's ankle joint in use.

8. A gait rehabilitation apparatus according to claim 7, in which the first member extends from proximate the shadow ankle joint, and the second member extends proximate a foot region of the shadow leg.

9. A gait rehabilitation apparatus according to claim 2, comprising:

a third member coupled to the shadow leg and having a third biological leg attachment formation defined thereon for attachment of the third member to the biological leg of the user; wherein the third member extends in a substantially anteroposterior direction to or from the shadow leg in use.

10. A gait rehabilitation apparatus according to claim 9, in which the articulated shadow leg comprises:

an upper leg portion articulated about a shadow hip joint at an upper end in use, wherein the shadow hip joint is at the height of the user's hip joint in use; and, a lower leg portion connected to the upper leg portion and articulated about a shadow knee joint at an upper end in use, wherein the shadow knee joint is at the height of the user's knee joint in use.

11. A gait rehabilitation apparatus according to claim 10, in which the first member extends from proximate the shadow hip joint, the second member extends proximate the shadow knee joint and the third member extends proximate an ankle region of the shadow leg.

12. A gait rehabilitation apparatus according to claim 11, comprising:

a fourth member coupled to the shadow leg and having a fourth biological leg attachment formation defined thereon for attachment of the fourth member to the biological leg of the user; wherein the fourth member extends in a substantially anteroposterior direction to or from the shadow leg in use.

13. A gait rehabilitation apparatus according to claim 12, in which the articulated shadow leg comprises a foot portion connected to the lower leg portion and articulated about a shadow ankle joint at an upper end in use, wherein the shadow ankle joint is at the height of the user's ankle joint in use.

14. A gait rehabilitation apparatus according to claim 13, in which the fourth member extends proximate a foot region of the shadow leg.

15. A method of gait rehabilitation comprising the steps of:

providing an articulated artificial mechanical shadow leg configured to mimic the movement of a biological leg;

providing a first member connected to the shadow leg;

providing a second member connected to the shadow leg;

attaching the first and second members to the biological leg of a user such that the first and second members extend in a substantially anteroposterior direction, wherein the biological leg of the user is located in a plane in front of or behind the shadow leg in use; and, using the shadow leg to guide and/or provide force input to the biological leg.

* * * * *